US005771422A

United States Patent [19]

Morihara

[11] Patent Number: 5,771,422

[45] Date of Patent: Jun. 23, 1998

[54] IMAGE FORMING APPARATUS

[75] Inventor: Kazushige Morihara, Kanagawa-ken, Japan

[73] Assignee: Kabushiki Kaisha Toshiba, Kanagawa-ken, Japan

[21] Appl. No.: 764,860

[22] Filed: Dec. 13, 1996

[30] Foreign Application Priority Data

Dec. 28, 1995 [JP] Japan ..... 7-352198

[51] Int. Cl.[6] ..... G03G 15/02

[52] U.S. Cl. ..... 399/50; 399/32; 399/46; 399/47

[58] Field of Search ..... 399/46–48, 50, 399/52, 32, 66, 315

[56] References Cited

U.S. PATENT DOCUMENTS

| | | | |
|---|---|---|---|
| 4,095,890 | 6/1978 | Herten | 399/32 |
| 4,326,796 | 4/1982 | Champion et al. | 324/457 |
| 4,346,986 | 8/1982 | Kuge et al. | 399/50 |
| 4,484,812 | 11/1984 | Takayanagi | 399/50 |
| 4,821,065 | 4/1989 | Ishii et al. | 347/236 |
| 4,821,068 | 4/1989 | Honma et al. | 399/51 |
| 4,922,293 | 5/1990 | Bando | 399/38 |
| 5,142,329 | 8/1992 | Nakaya | 399/11 |
| 5,159,388 | 10/1992 | Yoshiyama et al. | 399/26 |
| 5,161,084 | 11/1992 | Morihara et al. | 361/225 |
| 5,214,474 | 5/1993 | Ishizuka | 399/52 |
| 5,260,745 | 11/1993 | Takayanagi | 399/52 |
| 5,499,080 | 3/1996 | Furuya et al. | 399/50 |
| 5,568,231 | 10/1996 | Asano et al. | 399/175 |
| 5,697,010 | 12/1997 | Masuda et al. | 399/46 |
| 5,701,551 | 12/1997 | Honda et al. | 399/50 |

FOREIGN PATENT DOCUMENTS

| | | | |
|---|---|---|---|
| 63-158575 | 7/1988 | Japan | G03G 15/02 |
| 2-52375 | 2/1990 | Japan | G03G 15/02 |

*Primary Examiner*—Matthew S. Smith
*Attorney, Agent, or Firm*—Limbach, & Limbach, LLP

[57] ABSTRACT

An image forming apparatus includes an image carrier on which a static latent image is formed, a main charger to charge the image carrier, an operating portion to direct the output adjustment of the main charger, and a developing device to develop a static latent image by applying developer to it. Further, an image forming apparatus has a charge eliminator arranged between the main charger and the developing device along the rotating direction of the image carrier to fully remove the charge applied to the image carrier through the exposure when the output adjustment of the main charger is directed by the operating portion, and also has a detector to detect the current flowing into the image carrier when the image carrier is charged by the main charger after the output adjustment of the main charger is directed. The detected output of the detector is compared with a reference value, a control value corresponding to an error with the reference value is generated and voltage corresponding to this generated control value is supplied to the main charger.

10 Claims, 8 Drawing Sheets

IMAGE FORMING APPARATUS

BACKGROUND OF THE INVENTION

1. Field of the Invention

The present invention relates to an image forming apparatus which adjusts outputs of chargers arranged around a photosensitive drum of, for instance, an electronic copying machine.

2. Description of the Related Art

A quantity of electric charge applied to photosensitive drums differs by each photosensitive drum even when voltage applied to chargers is the same. Therefore, it is necessary to adjust the outputs of a main charger, a transferring charger and a separating charger provided around photosensitive drums according to respective photosensitive drums.

So far, when adjusting the outputs of a main charger, a transfer charger and a separating charger provided around a photosensitive drum, surface potential of a photosensitive drum was measured using a surface electrometer and according to the measured surface potential, voltage supplied to chargers was adjusted. However, a surface electrometer is large in shape and moreover, is expensive and therefore, it is not advisable to provide it in a copying machine.

So, a method to make the output adjustment of chargers using a special tool was developed. That is, when adjusting the output of a charger, remove a photosensitive drum from a main body of a copying machine and install an aluminum made tool in the same shape as the removed photosensitive drum. Then, applying the corona discharge to this tool by the main charger, measure a current or voltage value flowing out of the tool. Then, the variable resistance of a high power transformer connected to the main charger was manually adjusted so that this measured current or voltage value agrees with a preset value.

However, in the manual adjustment work using a tool described above, the adjustment adapted to an actual photosensitive drum was difficult and also, required a long time. Furthermore, as a photosensitive drum is different in size depending on a copying machine, a using tool must be changed according to a size of a photosensitive drum and thus, the adjusting work complicated.

So, in the Japanese Publication of Unexamined Patent Application (KOKAI TOKKYO KOHO) No. 02-250068, it was disclosed that a developing device was separated from a photosensitive drum by driving a motor, etc. when adjusting the output of a main charger. At the same time, a separating claw to mechanically separate a paper having a formed visible image from a photosensitive drum and a cleaning device to clean a developer remained on the surface of a photosensitive drum were separated, respectively by driving a solenoid, etc. Under this state, a corona discharging process and a charge eliminating process were carried out by a main charger and a charge elimination lamp and current or voltage flowing out of or flowing into a photosensitive drum was detected. By supplying current or voltage corresponding to an error between the detected output and a reference value to the chargers in order, the detected output was brought into the range of tolerance of a reference value, and it was proposed to store an adjusted value at the time when the detected output was brought into the range of tolerance of the reference value in a memory.

According to this Japanese Publication of Unexamined Patent Application (KOKAI TOKKYO KOHO) No. 02-250068, it is possible to eliminate such a work to exchange a photosensitive drum with a tool when adjusting the output without requiring a conventionally used tool. At the same time, as a changing amount adapted to a photosensitive drum used in actual copying can be set, it is possible to make a satisfactory adjustment.

However, the image forming apparatus proposed in the Japanese Publication of Unexamined Patent Application (KOKAI TOKKYO KOHO) No. 02-250068 was in such the construction that electric charge applied by the main charger located at the start position in the rotating direction of a photosensitive drum is eliminated by the charge elimination lamp located at the end position when adjusting the output of a main charger and therefore, a developer, a separation claw and a cleaning device located between the starting and the ending positions in the rotating direction of the photosensitive drum must be once separated from the photosensitive drum in the rotating process of the photosensitive drum. Accordingly, an evacuation space for separating respective driving mechanisms and other portions is needed. As a result, there was such a defect that the entire apparatus became large in size and complicated in structure.

SUMMARY OF THE INVENTION

It is an object of the present invention to provide an image forming apparatus that is capable of performing the output adjustment of a main charger automatically in a short time using an actual image carrier and also, making the construction and size of the entire apparatus simple and small without necessity for moving a developing device and the like in the adjustment.

According to the present invention, an image forming apparatus comprising an image carrier on which a static latent image is formed; main charging means for charging the image carrier; means for directing the output adjustment of the main charging means; means for developing the static latent image formed on the image carrier by applying a developer; charge eliminating means, arranged between the main charging means and the developing means along the rotating direction of the image carrier, for fully removing the charge applied to the image carrier through the exposure when the output adjustment is directed to the main charging means by the directing means; means for detecting the current flowing into the image carrier when the charging is made by the main charging means after the output adjustment of the main charging means is directed by the directing means; means for generating a control value corresponding to an error with a reference value by comparing the detected output of the detecting means with the reference value; and means for supplying a voltage corresponding to the control value generated by the generating means to the main charging means is provided.

DETAILED DESCRIPTION OF THE PREFERRED EMBODIMENTS

First Embodiment

Hereinafter, a first embodiment of the present invention will be described referring to the attached drawings.

Figure 1:
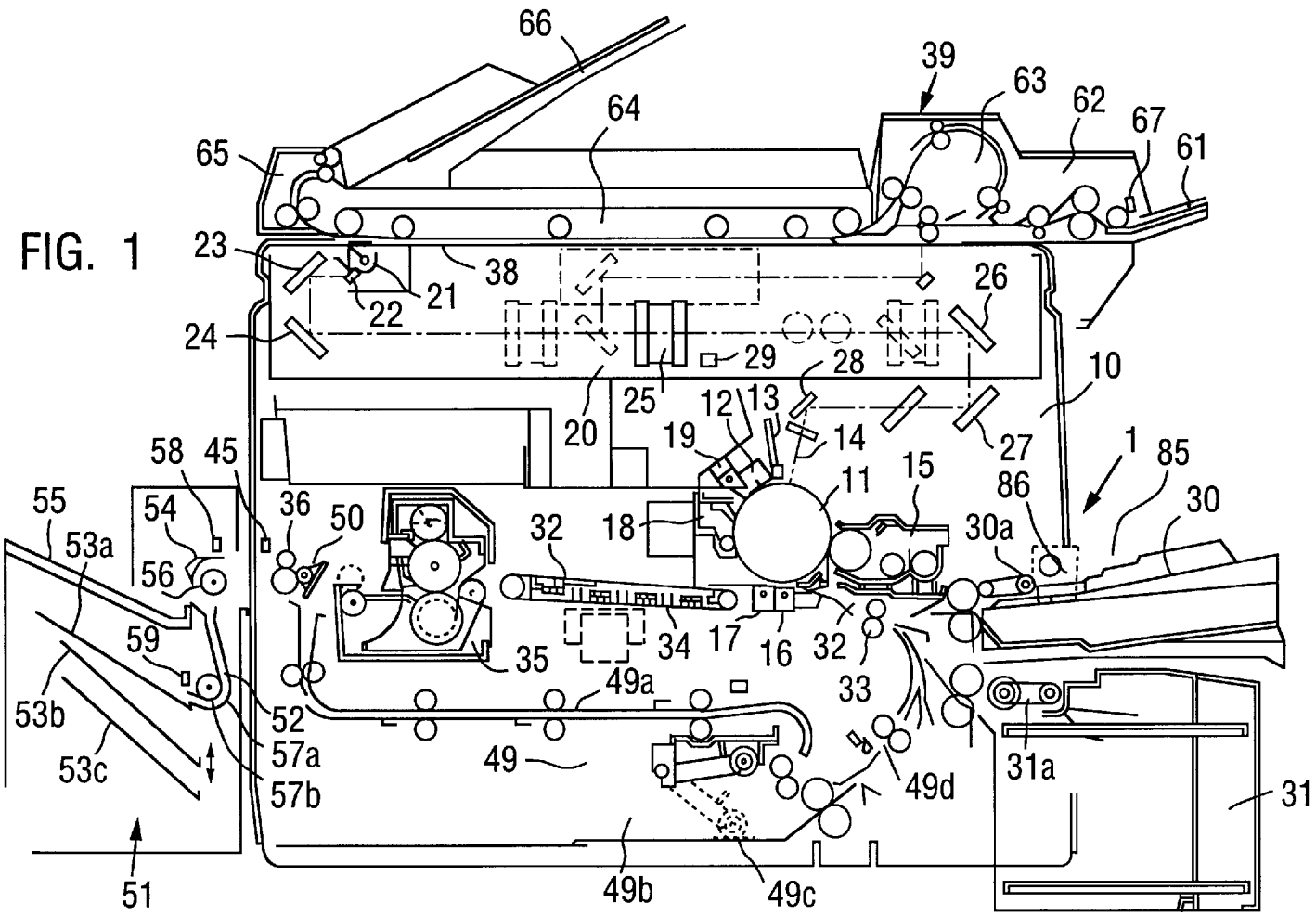
FIG. 1 is a cross-sectional view showing an internal construction of a copying machine involved in a first embodiment of the present invention.

FIG. 1 shows the internal construction of a copying machine 1 as an image forming apparatus of the present invention. At about the center in a main body 10 of the copying machine 1, a photosensitive drum 11 is provided rotatably. Around the photosensitive drum 11, there are provided a main charger 12, an LED (Light Emitting Diode) array 13, an exposing portion 14, a developing device 15, a transferring charger 16, a separating charger 17, a cleaner 18 and a charge eliminator 19 along the rotating direction of the photosensitive drum 11.

At the upper part in the main body 10, there is provided an exposure unit 20. The exposure unit 20 is composed of an exposure lamp 21, first through third reflecting mirrors 22–24, a lens block 25, fourth through sixth reflecting mirrors 26–28 and an automatic exposure sensor 29.

At one side of the main body 10, there are provide a paper supply cassette 30 and a large volume paper feeder 31 (LCF) for supplying 1000 sheets or more. Above the paper supply cassette 30, there is provided a manual paper supply tray 85 that is a manual paper supply portion. This manual paper supply tray 85 is provided with a manual paper supply detector 86 that optically detects supply of paper P.

If paper P that is most frequently used (e.g. A4 size paper) is set in the large volume paper feeder 31, it is possible to reduce the number of times causing out of paper.

Paper (image transfer medium) P supplied from the paper supply cassette 30 or the manual paper supply tray 85 by a paper feed roller 30*a,* or paper (image transfer medium) P supplied from the large volume paper feeder 31 by the paper feed roller 31*a* is conveyed along a paper conveying path 32 provided in the main body 10.

Along the conveying direction of paper P, there are provided an aligning roller 33, the transferring and separating chargers 16 and 17, a conveyor belt 34, a fixer 35 and an exit roller pair 36 are provided in order to the paper conveying path 32.

On the top of the main body 10, a document table 38 is provided and an automatic document feeder 39 is provided on the top of this document table 38.

At a document discharging portion of the main body 10, a sorter 51 is provided. The sorter 51 is composed of a conveying roller 56 to convey paper P from the document discharging portion of the main body 10, a switching gate 54 to divide paper P conveyed by the conveying roller 56 into a sorting portion and a non-sorting portion, a paper conveying path 52 to convey paper P divided by the switching gate 54 for the sorting, bins 53*a,* 53*b,* and so on movably provided in the vertical direction by a bin moving mechanism (not shown) opposing to the exit of the paper conveying path 52 and a paper receiving tray 55 to eject paper P divided by the switching gate 54 for the non-sorting.

The paper conveying path 52 is composed of a conveying guide 57*a* and a conveying roller 57*b*.

Near the conveying roller 56, a detector 58 is provided to detect paper P inserted into a sorter from the document discharging portion of the main body 10. Near the conveying roller 57*b,* a detector 59 is provided to detect paper P conveyed to the bins 53*a,* 53*b,* and so on.

In FIG. 1, a switching gate 50 is provided neat the exit roller pair 36 to switch the route to eject paper P to the sorter 51 side that is outside the main body 10 or to lead to an automatic duplex device 49. Paper P led to the automatic duplex device 49 is stacked in a stacker after both sides are turned over by a paper conveying path 49*a* and then, taken out one by one by a paper feed roller 49*c* and conveyed by a paper conveying path 49*d* again along the paper conveying path 32.

In the normal copying, an original document O placed on the document table 38 is optically scanned by the exposure unit 20, and its reflecting light is focused on the photosensitive drum 11 of which surface is charged by the main charger 12 and a static latent image is formed. This static latent image is developed by a developer supplied by the developing device 15 that is fixed to the photosensitive drum 11. At this time, paper P is supplied from the paper supply cassette 30 or the large volume paper feeder 31 between the photosensitive drum 11 and the transferring charger 16 and the developed image on the photosensitive drum 11 is transferred onto the paper P. The paper P having the image transferred is separated from the photosensitive drum 11 by the charging action by AC driving of the separating charger 17, conveyed to a fixer 35 by the conveyor belt 34 and the image is fixed. The paper P having this fixed image is ejected by the exit roller pair 36 in the paper receiving tray 55 or the bins 53*a,* 53*b,* and so on, selectively by the switching gate 54 of the sorter 51. The ejection of paper P by the exit roller pair 36 is detected by the detector 45 that serves as a paper discharging switch.

When a part of an original document O placed on the document table 38 is masked in advance and that masked region only is not copied, as an editing process, the masked region is designated by the operation panel (not shown), the LED array 13 is selectively driven to light the photosensitive drum 11 of which surface is charged by the main charger 12 before forming a static latent image by the exposure unit 20 and the designated masked region is exposed and discharged in advance so that a static latent image is not formed.

Separately from this editing process, the reflecting light from the original document O by the exposure unit 20 is detected properly by the automatic exposure sensor 29, the white/black image ratio in the original document O is judged according to the result of this detection and the increase or decrease of luminous quantity of the exposure lamp 21 is controlled.

When the original document O is copied in plural sheets and sorted, the switching gate 54 is switched to the sorter 51 side and paper P is conveyed by the conveying path 52, divided and selectively sorted to the bins 53*a,* 53*b* and so on corresponding to the exit of the conveying path 52. The bins 53*a,* 53*b* and so on are moved up and down by a bin moving mechanism (not shown) to face the exit of the conveying path 52, respectively.

Further, when both sides of paper P are copied, the switching gate 50 is switched to the automatic duplex device 49 side, paper P is led to the stacker 49*b* by the paper conveying path 49*a,* stacked there after its both sides are turned over and then, taken out one by one by the paper feed roller 49*c,* conveyed by the paper conveying path 49*d* again along the paper conveying path 32, an image is transferred to the back side, fixed and ejected.

An automatic document feeder 39 is composed of a document feeding table 61, a one sheet take-in portion 62, a document reversing portion 63, a conveying portion 64, a document discharging portion 65, a document receiving portion 66 and a document detector 67.

On the document feeding table 61, one or plural sheets of the original document O are placed. The one sheet take-in portion 62 is to take and convey an original document placed on the document feeding table 61 by one sheet at a time. The document reversing portion 63 conveys the original document O from the one sheet take-in portion 62 directly to the conveying portion 64 or returns the original document O from the conveying portion 64 to the conveying portion 64 again by turning it over. The conveying portion 64 conveys the original document O from the reversing portion 63 and sets it at the standard position on the document table 38 or conveys the original document O on the document table 38 to the document reversing portion 63 or the document discharging portion 65. The document discharging portion 65 discharges the original document O from the conveying portion 64 onto the document receiving portion 66.

The document detector 67 optically detects whether the original document O is placed on the document feeding table 61.

Figure 2:
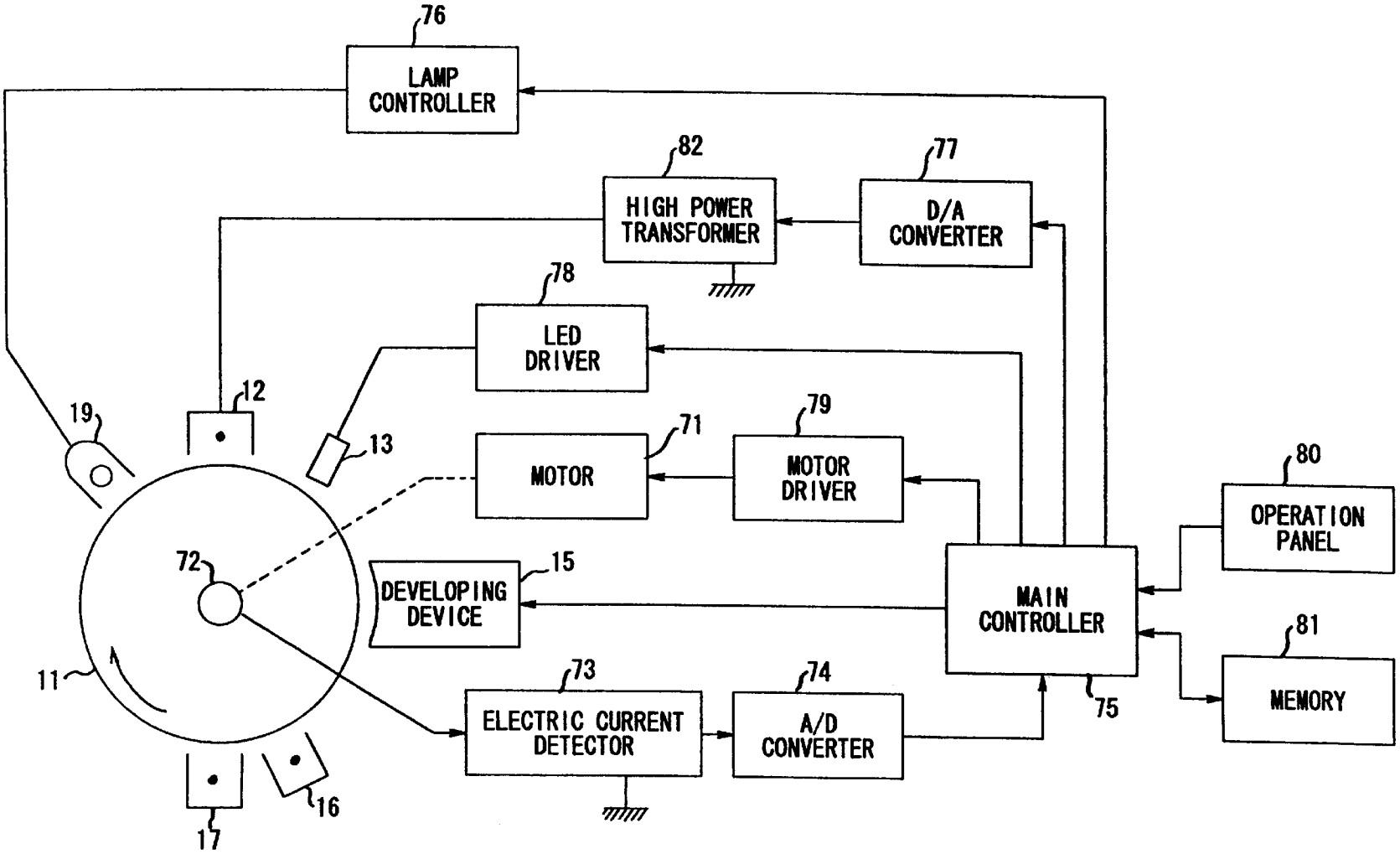
FIG. 2 is a block diagram showing a control construction involved in the first embodiment.

Next, the control construction when adjusting the output of the main charger 12 in installing the copying machine 1 shown in FIG. 1 or during its periodic inspection, etc. will be described referring to FIG. 2. Further, the same component elements in FIG. 2 as those shown in FIG. 1 will be assigned with the same reference numerals and the explanation thereof will be omitted.

The photosensitive drum 11 is rotated by a motor 71 in the arrow direction centering around a conductive supporter 72. The conductive supporter 72 is connected with an electric current detector 73 and this electric current detector 73 detects the electric current flowing into the conductive supporter 72 from the photosensitive drum 11 when adjusting the main charger 12. This detection is not limited to current but voltage may be detected.

The detected output of the electric current detector 73 is digitized through an A/D converter 74 and supplied to a main controller 75. The main controller 75 controls the entire operation of the copying machine 1 and is connected with a lamp controller 76, a D/A converter 77, an LED driver 78, a motor driver 79, the developing device 15, an operation panel 80 and a memory 81.

The lamp controller 76 lights and controls the charge eliminator 19.

The D/A converter 77 converts digital signal supplied from the main controller 75 into analog signal and supplies to a high power transformer 82. This high power transformer 82 supplies a prescribed current or voltage to the main charger 12 according to the analog signal supplied from the D/A converter 77.

The LED driver 78 drives to selectively light a part of the LED array 13 corresponding to the masked range when performing the editing process during the normal copying and drives fully light the LED array 13 when adjusting the output of the main charger 12.

On the operation panel 80, there are provided a copying key to direct the start of the copying, a ten-key that is used to set the number of sheets to be copied and the masking range in the editing process, the output adjusting mode of the main charger 12 that will be described later, etc., and a display portion to display the input number of sheets to be copied, etc.

In the memory 81, an adjusted output value of the main charger 12 and a program to control the operation of the main controller 75, etc. are stored.

Now, the output adjusting operation of the main charger 12 in the above construction will be described referring to FIG. 3 and FIG. 4.

When a preset charger output adjusting code is input by the ten-key on the operation panel, the main controller 75 is set at the charger output adjusting mode and this set mode is displayed on the display on the operation panel 80 (Step A1).

Under this state, the motor 71 is driven by the motor driver 79, the LED array 13 is first fully lighted by the LED driver 78 and the charge eliminator 19 is then lighted by the lamp controller 76 (Step A2). Then, the main charger 12 charges the photosensitive drum 11 by the prescribed current or voltage supplied from the high power transformer 82 based on the signal from the main controller 75 (Step A3).

Pursuant to this, the corona discharge process by the main charger 12, the charge removing process by the LED array 13 and the auxiliary charge removing process by the charge eliminator 19 are executed in order for the photosensitive drum 11 and the automatic adjusting process of the output of the main charger 12 shown below is carried out (Step A4).

Figure 4:
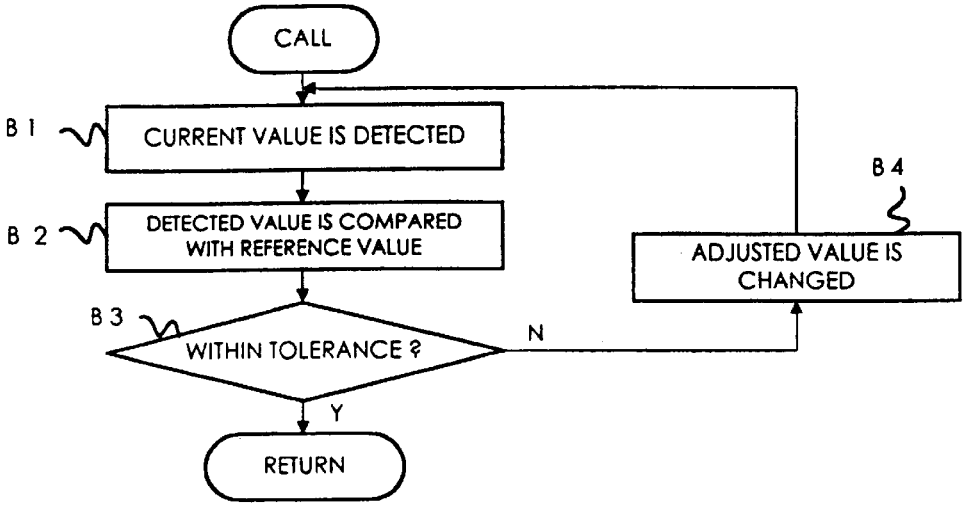
FIG. 4 is a flowchart showing the process contents of a subroutine for the automatic output adjustment shown in FIG. 3.

FIG. 4 is a flowchart of a subroutine for the automatic adjusting process of the output of the main charger 12. That is, the current flowing out to the conductive supporter 72 from the photosensitive drum 11 (in case of the reverse polarity charge, the current flowing into the conductive supporter 72) is detected by the electric current detector 73 (Step B1). This detected value is digitized through the A/D converter 74 and supplied to the main controller 75.

In the main controller 75, the detected value is compared with a reference value pre-stored in the memory 81 (Step B2) for judging whether the detected value is within the tolerance of the reference value (Step B3) and if the detected value is judged to be outside the tolerance of the reference value, for instance, a digital value "128" is output to the D/A converter 77 as an adjusting value (Step B4).

In the D/A converter 77, control current (or control voltage) corresponding to the digital value is generated and supplied to the high power transformer 82. Then, by the output of the high power transformer 82 corresponding to this control current, the corona discharging process is carried out again by the main charger 12 and the operations of the steps B1–B3 are carried out.

That is, the corona discharging process by the main charger 12, the charge removing process by the LED array 13 and the auxiliary charge removing process by the charge eliminator 19 are carried out in order and pursuant to these processes, the current flowing out of the photosensitive drum 11 is detected by the electric current detector 73. The detected value is compared with a reference value by the main controller 75.

As a result of the comparison, if the detected value is lower than the reference value, a digital value, for instance, "192" is output as an adjusting value and if it is higher than the reference value, a digital value, for instance, "64" is output as an adjusting value and the operations in Steps B1–B3 are repeated.

Thus, adjusting values are set in order according to errors between detected values and the reference value so as to bring a detected value in the range of a tolerance of the reference value.

Figure 3:
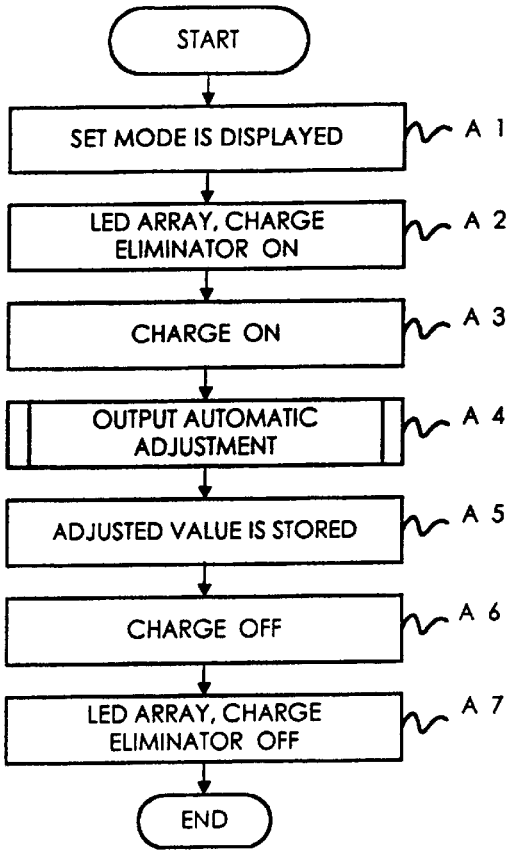
FIG. 3 is a flowchart showing the contents of the entire adjustment process of a main charger involved in the first embodiment.

When it is judged that a detected value is brought in the range of a tolerance of the reference value as a result of the above operations (Step B3), the subroutine shown in FIG. 4 is terminated and the process returns to that shown in FIG. 3, and an adjusting value at that time is stored in the memory 81 (Step A5).

Then, the charging by the main charger 12 through the high power transformer 82 is turned off (Step A6), the driving of the motor 71 by the motor driver 79, the full lighting of the LED array 13 by the LED driver 78 and the auxiliary lighting of the charge eliminator 19 by the lamp controller 76 are all stopped (Step A7), and the output adjusting process of the main charger 12 shown in FIG. 3 is terminated.

Hereinafter, when the normal copying operation is carried out, an output value of the main charger 12 is decided based on the adjusting value obtained by the output adjusting process and stored in the memory 81.

According to the first embodiment described above, as the output of the main charger 12 is adjusted using the photosensitive drum 11, it is possible to perform the output adjustment that enables the setup of a charge quantity based on the photosensitive drum 11 that is used in the actual copying without requiring a tool and also, without exchanging the photosensitive drum 11 with a tool.

Further, the photosensitive drum 11 that is charged by the main charger 12 in the output adjustment is fully discharged by the LED array 13 for the editing process arranged in front of the developing device 15 in the rotating direction of the photosensitive drum 11. Therefore, the developing device does not apply excessive developer to the photosensitive drum 11. As a result, it becomes unnecessary to separate the developing device 15 and others from the photosensitive drum 11, the moving mechanism for the developing device 15 and other units and an evacuation space also become unnecessary. Thus, it becomes easy to make the entire construction of the copying machine 1 simple and small in size.

Further, as the output adjustment is automatically carried out when the main controller 75 is set in the output adjusting mode, it is not necessary to perform such works as adjustment of a variable resistance of the high power transformer 82 according to the result of detection. Accordingly, it is possible to make the adjusting work easy, a time required for the adjusting work short and achieve the uniform adjustment by removing fluctuation in the adjustment resulting from a difference in the degree of skill of persons performing the adjustment.

Further, as the adjusting value obtained by the adjustment is stored in the memory 81 and the next adjustment can be started using this adjusting value, it is possible to start the adjusting operation from the state of less error between a detected value and a reference value. Accordingly, it is possible to further shorten a time required for the adjustment sharply.

Second Embodiment

Hereinafter, a second embodiment of the present invention will be described referring to the drawings.

As the internal construction itself of the copying machine 1 as an image forming apparatus of this invention is the same as that shown in FIG. 1, the same reference numerals will be assigned to the same component elements and the illustrations and explanations thereof will be omitted.

Figure 5:
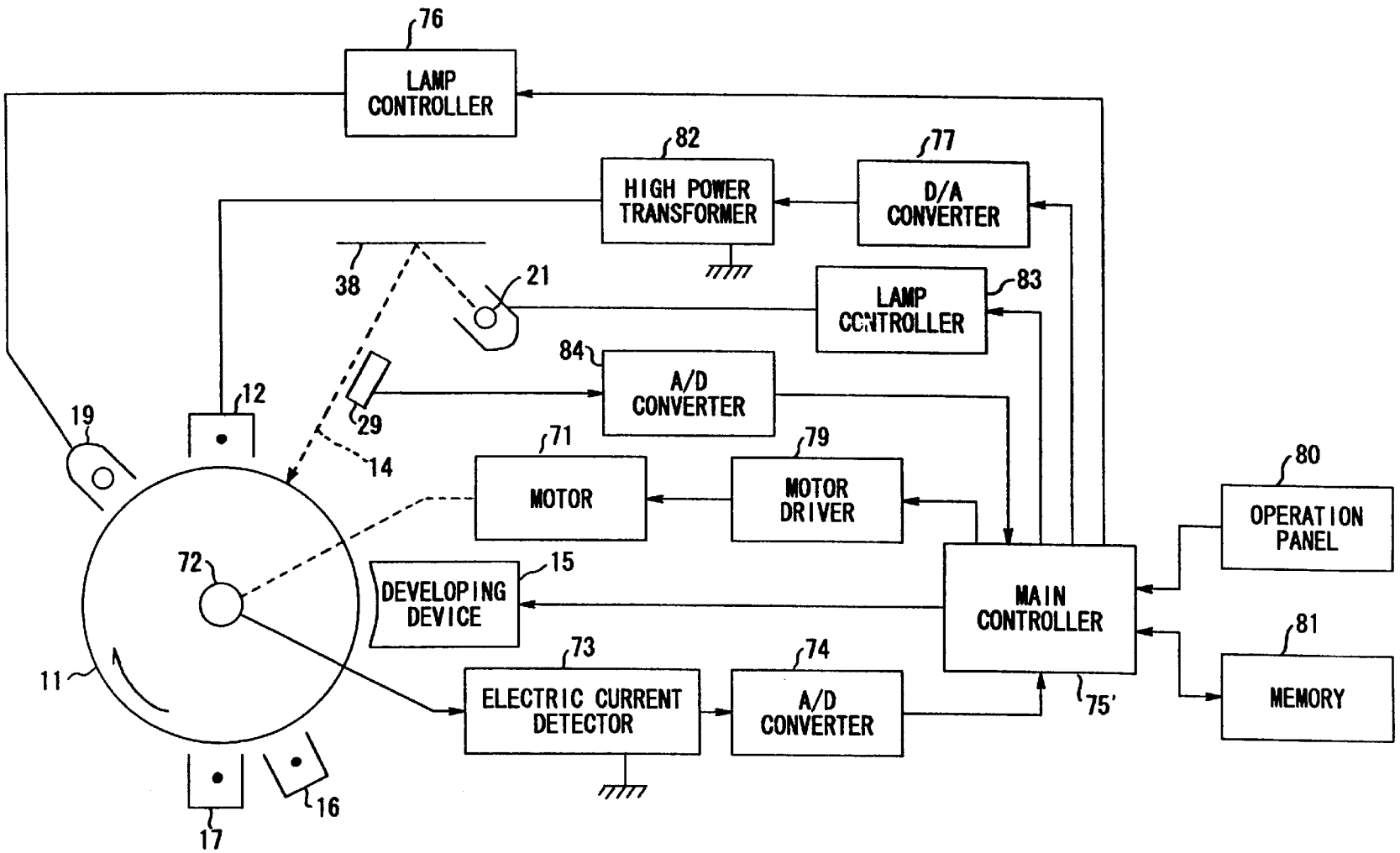
FIG. 5 is a block diagram showing the control construction of the main charger involved in a second embodiment of the present invention.

Now, referring to FIG. 5, the construction and control of the copying machine 1 when performing the output adjustment of the main charger 12 in installing and/or performing the periodic inspection, etc. of the copying machine 1 will be described. Further, the same component elements in FIG. 5 as those shown in FIG. 2 will be assigned with the same reference numerals and the explanations thereof will be omitted.

The detected output of the electric current detector 73 is digitized and supplied to the main controller 75' through the A/D converter 74.

The main controller 75' controls the operation of the entire copying machine 1 and the lamp controller 76, the D/A converter 77, the lamp controller 83, the A/D converter 84, the motor driver 79, the developing device 15, the operation panel 80 and the memory 81 are connected thereto.

The lamp controller 83 controls the ON/OFF and luminous quantity of the exposure lamp 21 of the exposure unit 20 under the control of the main controller 75'.

The A/D converter 84 converts the detected output of analog signal from the automatic exposure sensor 29 which detects the quantity of reflecting light from the original document O on the document table 38 when the light of the exposure lamp 21 was reflected and applied to the photosensitive drum 11 via the exposing portion 14 into digital signal, and in the normal copying operation, the main controller 75' controls increase/decrease of quantity of luminous light from the exposure lamp 21 by judging a ratio of white/black image on an original document by the digital signal from the A/D converter 84.

The output adjusting operation of the main charger 12 in the above construction will be described referring to FIG. 6.

When a preset output adjusting code of a charger is input by the ten-key on the operation panel 80, the main controller 75' is set in the charger output adjusting mode and this set mode is displayed on the display on the operation panel 80 (Step C1).

Under this state, first a carriage including the exposure lamp 21 and a first reflecting mirror 22 for the scanning operation (Step C2) is moved and at the same time, the exposure lamp 21 is driven to light by the lamp controller 83 (Step C3).

The main controller 75' receives the detected output from the automatic exposure sensor (referred to as "AES" in FIG. 6) at this time as a digital signal that is output from the A/D converter 84 and judges whether this received value is above a specified value that was pre-set and stored in the memory 81, that is, the light applied by the exposure lamp 21 was reflected on the document table 38 and arrived at the photosensitive drum 11 from the exposing portion 14 (Step C4).

Here, when the detected output of the automatic exposure sensor 29 is judged to be less than a specified value; that is, when it is judged that for the reason that, for instance, the document table 38 is in the open state without the original document O, the light applied from the exposure lamp 21 was not reflected and did not arrive at the photosensitive drum 11 and the full discharging by the light emission of the exposure lamp 21 is impossible, it is not possible to perform the output adjusting process. Also, as this state is left as it is, the unnecessary development is made by the developing device 15 and a large quantity of developer is applied to the photosensitive drum 11 and therefore, the exposure lamp 21 is turned OFF by the lamp controller 83 (Step C10), the scanning operation by moving the carriage including the exposure lamp 21 is stopped at the same time (Step C11) and the output adjusting process of the main charger 12 shown in FIG. 6 is completed.

Further, when the detected output of the automatic exposure sensor 29 in Step C4 was judged to be above the specified value, regarding that the full discharging by the light emission of the exposure lamp 21 is possible, the motor 71 is driven by the motor driver 79, and the main charger 12 charges the photosensitive drum 11 by a prescribed current or voltage supplied from the high power transformer 82 based on the signal from the main controller 75'. Further, the charge eliminator 19 is lighted by the lamp controller 76 (Step C5).

Pursuant to this, the corona discharging process by the main charger 12, the charge removing process by the exposure lamp 21 and the auxiliary charge removing process by the charge eliminator 19 of the photosensitive drum 11 are carried out in order and the automatic adjusting process of the output of the main charger 12 is carried out (Step C6).

For the automatic adjusting process of the output of the main charger 12, a subroutine shown in FIG. 4 is executed and an adjusting value is set in order according to an error between a detected value and a reference value so as to bring a detected value in the range of a tolerance of the reference value.

Figure 6:
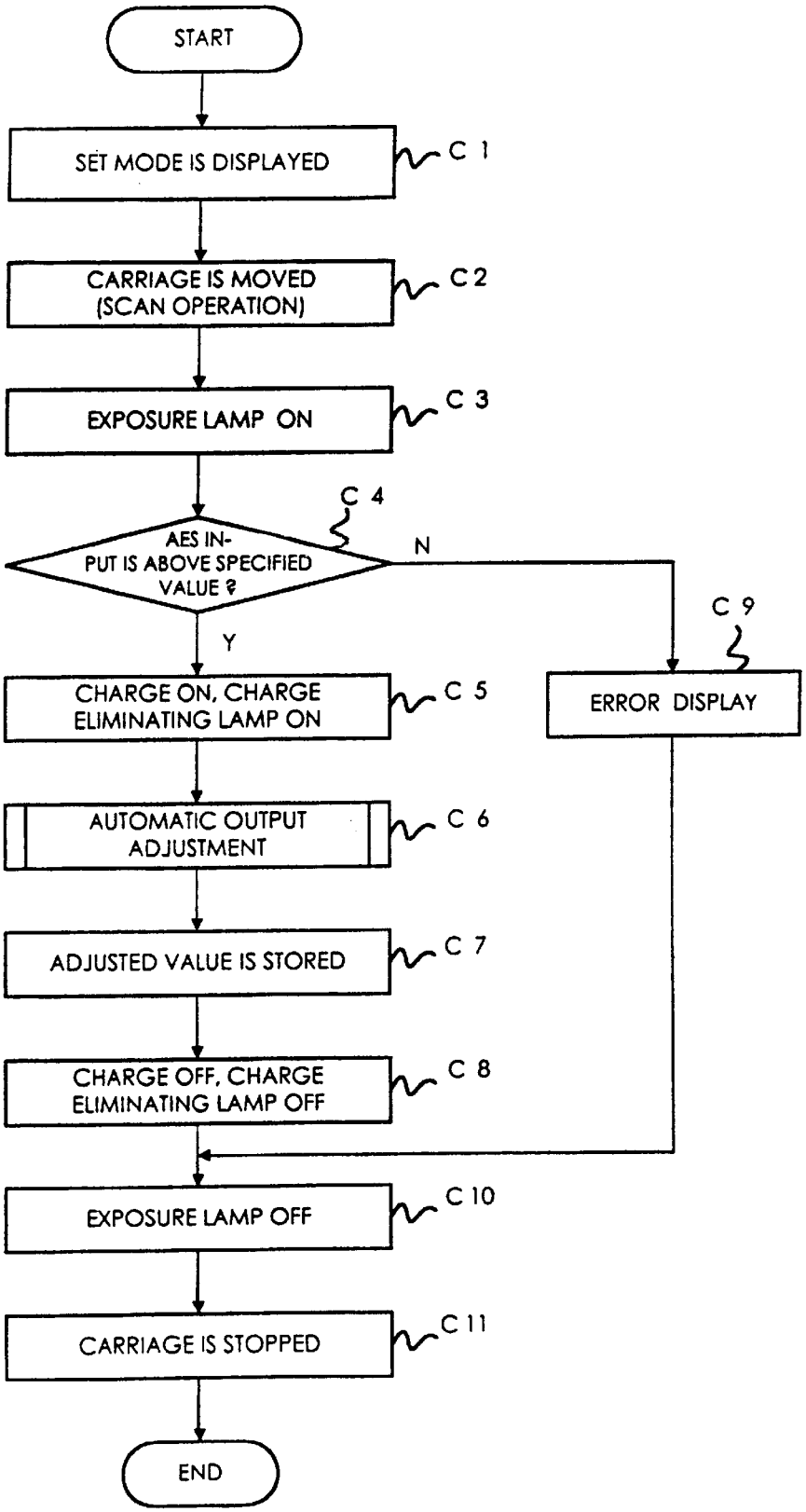
FIG. 6 is a flowchart showing the contents of the entire output adjusting process of the main charger involved in the second embodiment.

When it is judged that a detected value is brought in the range of a tolerance of the reference value as a result of this output adjusting process, the subroutine shown in FIG. 4 is terminated and the process returns to that shown in FIG. 6 and an adjusted value at the time is stored in the memory 81 (Step C7).

Then, the charging by the main charger 12 through the high power transformer 82 is turned OFF, the driving of the motor 71 by the motor driver 79 and the auxiliary lighting of the charge eliminator 19 by the lamp controller 76 are stopped (Step C8).

Thereafter, the exposure lamp 21 is turned OFF in Step C10 and at the same time, the scanning operation by moving the carriage including the exposure lamp 21 is stopped in Step C11 and the output adjusting process of the main charger 12 shown in FIG. 6 is now completed.

Thereafter, when the normal copying operation is performed, the output value of the main charger 12 is decided based on the adjusted value obtained in the above output adjusting process and stored in the memory 81.

According to the second embodiment described above, it is possible to make the output adjustment that enables to set a quantity of charge based on the photosensitive drum 11 that is used in the actual copying without requiring a tool and without the work to exchange the photosensitive drum 11 with a tool as the output of the main charger 12 is adjusted using the photosensitive drum 11.

Further, when adjusting the output of the main charger 12, the photosensitive drum 11 that is charged by the main charger 12 is fully discharged using the light emission of the exposure lamp by the exposing portion 14 arranged in front of the developing device 15 in the rotating direction of the photosensitive drum 11. Therefore, it is possible to perform the output adjusting process certainly even on a copying machine 1 that has no LED array 13 for the editing process as in the first embodiment and the developing device 15 does not apply unnecessary developer to the photosensitive drum 11. As a result, it becomes unnecessary to make the operation to separate the developing device 15 and others from the photosensitive drum 11. Accordingly, the developing device 15 and other parts moving mechanism and an evacuation space accompanied with the movement become unnecessary and it becomes easy to make the entire construction of the copying machine 1 simple and small in size.

In this case, if it is not possible to fully discharge the charged photosensitive drum 11 by the light emission of the exposure lamp 21 because the light applied from the exposure lamp 21 is not reflected on the document table 28 and does not reach the photosensitive drum 11 as the document table 38 is in the open state without an original document placed on it as described above, it is judged from the detected output of the automatic exposure sensor 29 and the output adjusting process is interrupted. Therefore, it is possible to prevent the developing device 15 from making the unnecessary development and applying a large amount of developer on the photosensitive drum 11.

Further, as the automatic output adjustment is carried out when the main controller 75' is set in the output adjusting mode, it is not necessary to perform such works as the adjustment of variable resistance of the high power transformer 82 according to the result of detection. Accordingly, it is possible to make the adjusting work easy, a time required for the adjusting work short and achieve the uniform adjustment by removing fluctuation in the adjustment resulting from a difference in the degree of skill of persons performing the adjustment.

Further, as an adjusting value obtained by the adjustment is stored in the memory 18 and the next adjustment can be started using this adjusting value, it becomes possible to perform the adjusting operation from the state with less error between the detected value and the reference value and thus, a time required for the adjustment can be further shortened sharply.

Third Embodiment

The copying machine described in the above embodiments is a so-called analog copying machine and the example of the output adjustment of the charger in this analog copying machine is explained in the above embodiments. The present invention is also applicable to a so-called digital copying machine which exposes a latent image by laser beams.

So, the invention of this patent application will be described using an example where this invention was applied to a digital copying machine using a laser optical system.

Figure 7:
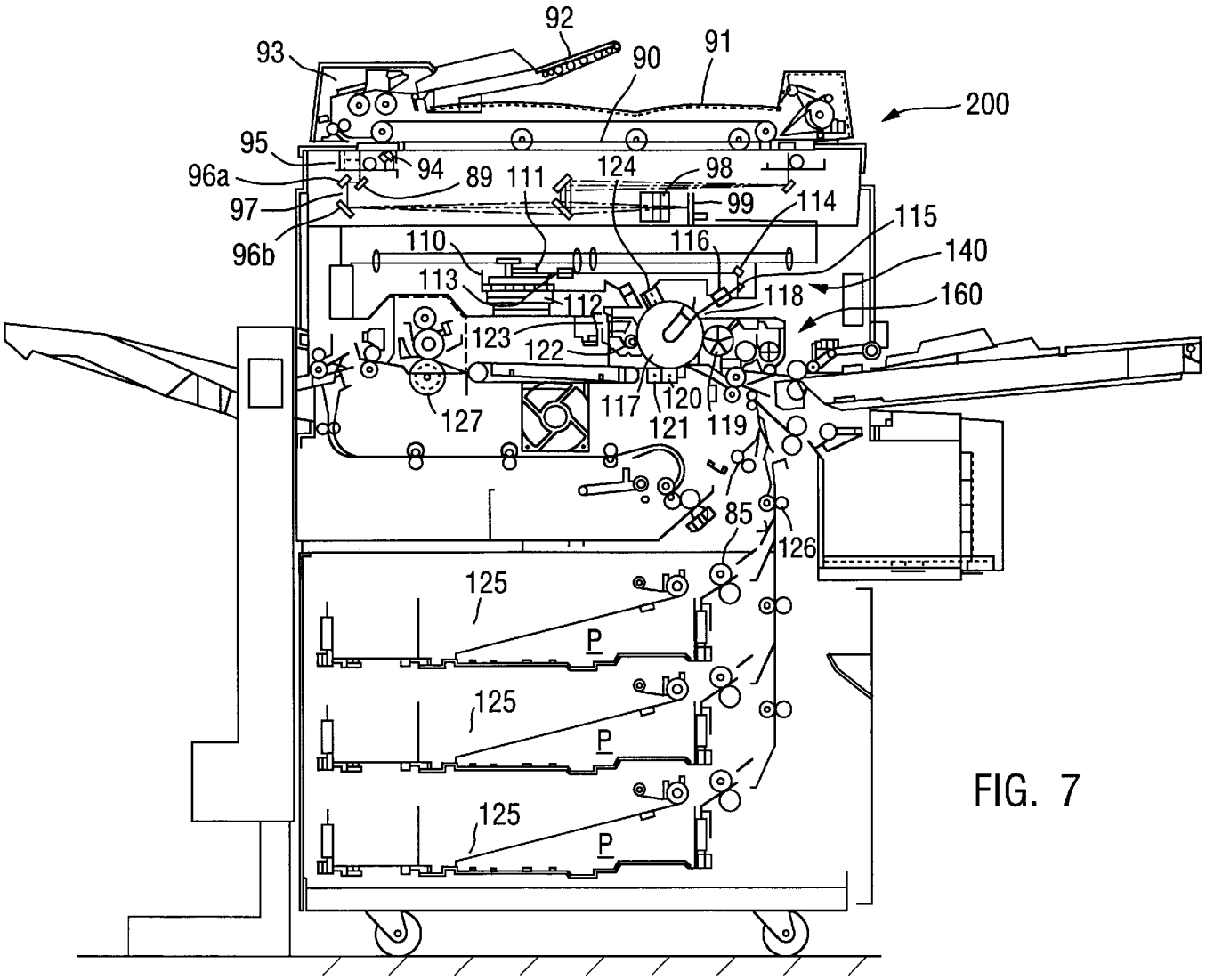
FIG. 7 is a cross-sectional view showing an internal construction of a digital copying machine involved in a third embodiment of the present invention.

FIG. 7 briefly shows the entire construction of a digital copying machine that is an image forming apparatus of this invention. This apparatus is equipped with a document scanning portion 140 and an image forming portion 160, and on the top there is provided an automatic document feeder 200.

The rear edge of a cover 91 of the body of the automatic document feeder 200 is attached to the top rear edge of the main body of the apparatus via hinges (not shown) in the state it can be opened/closed freely and the top of a document table 90 can be opened as necessary by displacing and rotating the entirety of the automatic document feeder 200. At the slightly left region of the main cover 91, there is provided a document feeding table 92 that is capable of holding a plurality of documents collectively. At one side of the apparatus, there is provided a feeding means 93 to feed a document to one end (the left end in the figure) of the document table 90 taking it out one by one in order.

The document scanning portion 140 is composed of an exposure lamp 94 as a light source, a first carriage 95 equipped with a mirror 89, a second carriage 97 equipped with mirrors 96*a* and 96*b* to bend an optical path, a lens 98 and an A/D converter (not shown) to convert the output of a photoelectric converter 99 to receive the reflecting light, that is, image data from analog data to digital data. The first and second carriages 95 and 97 are connected to each other by a timing belt (not shown) and the second carriage 97 moves in the same direction at a ½ speed of the first carriage 95. Thus, it is possible to scan a document so that the optical path length up to the lens 98 becomes constant. The lens 98 is of fixed focal distance type and is moved in the direction of optical axis when a magnification is varied. The photoelectric converter 99 is to photoelectrically convert the reflecting light from an original document and is composed of mainly, for instance, a CCD line image sensor, etc. In this case, one pixel of an original document corresponds to one element of a CCD sensor. The output of the photoelectric converter 99 is output to the A/D converter. The first and second carriages 95 and 97 and the mirrors 96*a* and 96*b* are moved by a stepping motor (not shown), respectively. The first and second carriages 95 and 97 are moved according to the movement of a timing belt (not shown) put between a drive pulley (not shown) and an idle pulley (not shown) which are connected to the rotary shaft of the stepping motor. The lens 98 is moved in the direction of optical axis by the rotation of a spiral shaft (not shown) which is rotated by a corresponding stepping motor (not shown).

Reference numeral 110 denotes a laser generator that is a beam generating means comprising semiconductor laser and corresponding to the laser generator 110, there are arranged a collimate lens 111, a polygonal mirror 112, a lens 113, reflecting mirrors 114 and 115 and a lens 116, and the laser beam generated from the laser generator 110 is applied to a photosensitive drum 117.

The image forming portion 160 is a combination of, for instance, a laser optical system and an electrophotographic system. That is, the image forming portion 160 is provided with the photosensitive drum 117 that is an image carrier rotatably supported almost at the center in the apparatus. Around the photosensitive drum 117, there are arranged a main charger 124, an exposing portion 118, a developing device 119, a transferring charger 120, a separating charger 121, a cleaning charger 122 and a charge eliminator 123 along the rotating direction of the photosensitive drum 117. The photosensitive drum 117 is uniformly charged by the main charger 124, an original document image is focused on the photosensitive drum 117 by applying the laser beam to the exposing portion 118 and a static latent image is formed thereon.

The static latent image formed on the photosensitive drum 117 is developed by the developing device 119 and the developed image is transferred onto a paper P that is fed from a paper supply cassette 125 which is a paper feeding means described later by the transferring charger 120. The paper P having the image transferred by the transferring charger 120 is separated from the photosensitive drum 117 by the separating charger 121 by the AC corona discharge. The separated paper P is conveyed to a fixer 127 by the conveyor belt and the developed image is fixed.

Figure 8:
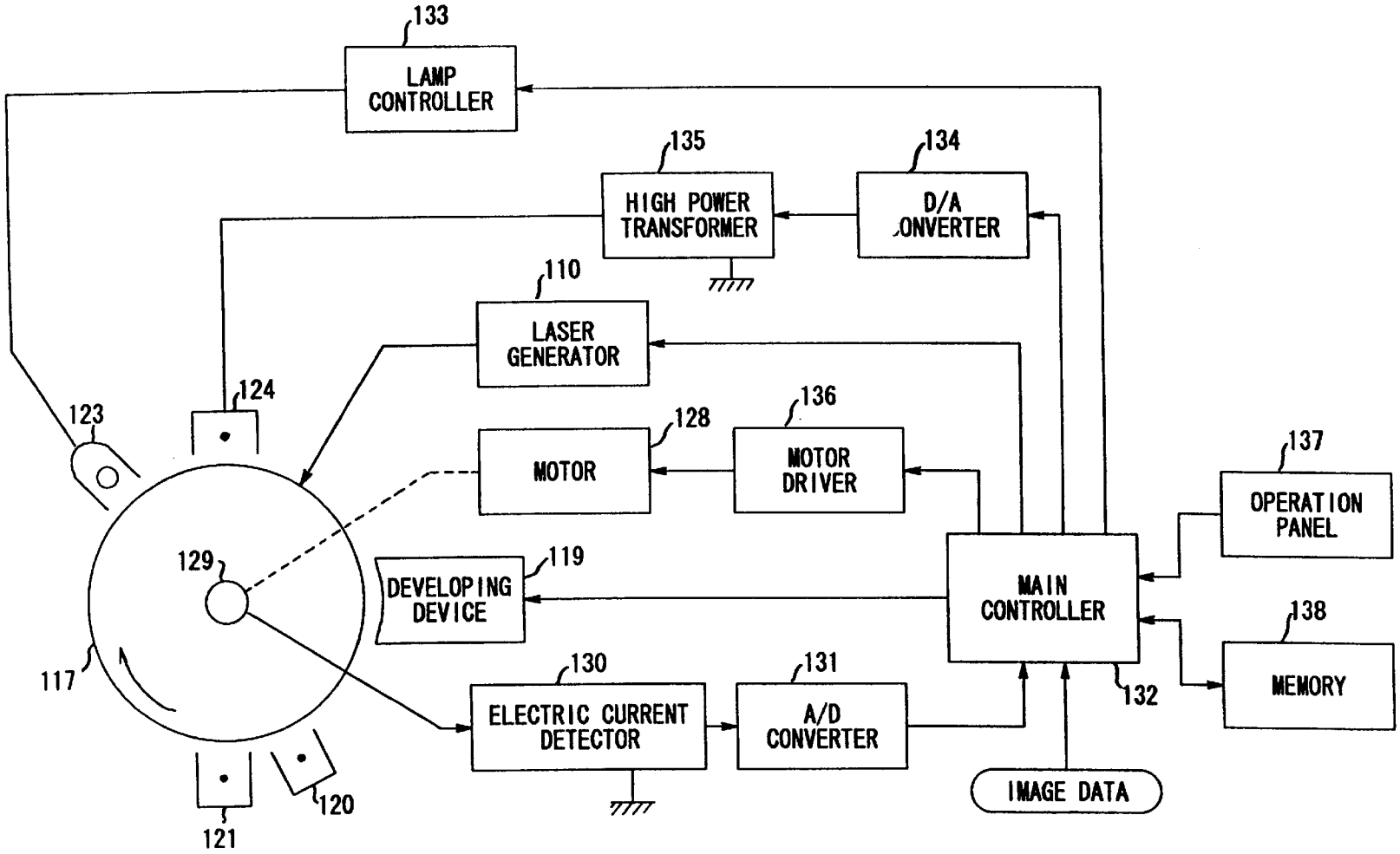
FIG. 8 is a block diagram showing a control construction involved in the third embodiment.

Next, the control construction when adjusting the output of the main charger 124 in installing or during the periodic inspection of a digital copying machine shown in FIG. 7 will be described referring to FIG. 8.

The photosensitive drum 117 is rotated in the arrow direction by a motor 128 centering around a conductive supporter 129. An electric current detector 130 is connected to the conductive supporter 129 and the current flowing into the conductive supporter 129 from the photosensitive drum 117 when adjusting the main charger 124 is detected by the electric current detector 130. This detection is not limited to current value only but voltage value may be detected.

The detected output of the electric current detector 130 is digitized through an A/D converter 131 and supplied to a main controller 132. The main controller 132 controls the operation of the entire digital copying machine and a lamp controller 133, a D/A converter 134, a laser generator 110, a motor driver 136, a developing device 119, an operation panel 137 and a memory 138 are connected thereto.

The lamp controller 133 controls the lighting of the charge eliminator 123.

The D/A converter 134 converts digital signal supplied from the main controller 132 into analog signal and supplies to a high power transformer 135. This high power transformer 135 supplies prescribed current or voltage to the main charger 124 according to analog signal supplied from the D/A converter 134.

The main controller 132 controls the laser generator 110 based on image data read by a document scanning portion 140 or image data transmitted from the outside via a communication means (not shown) and forms a static latent image on the photosensitive drum 117.

On the operation panel 137, there are provided a copying key to direct start of the copying, a ten-key that is used for setting the number of sheets to be copied, the masking range in the editing process, the output adjusting mode of the main charger 124 that will be described later, and a display portion to display the number of sheets to be copied that are input by the ten-key.

In the memory 138, output adjusting values of the main charger 124, a program to control the operation of the main controller 132, etc. are stored.

Figure 9:
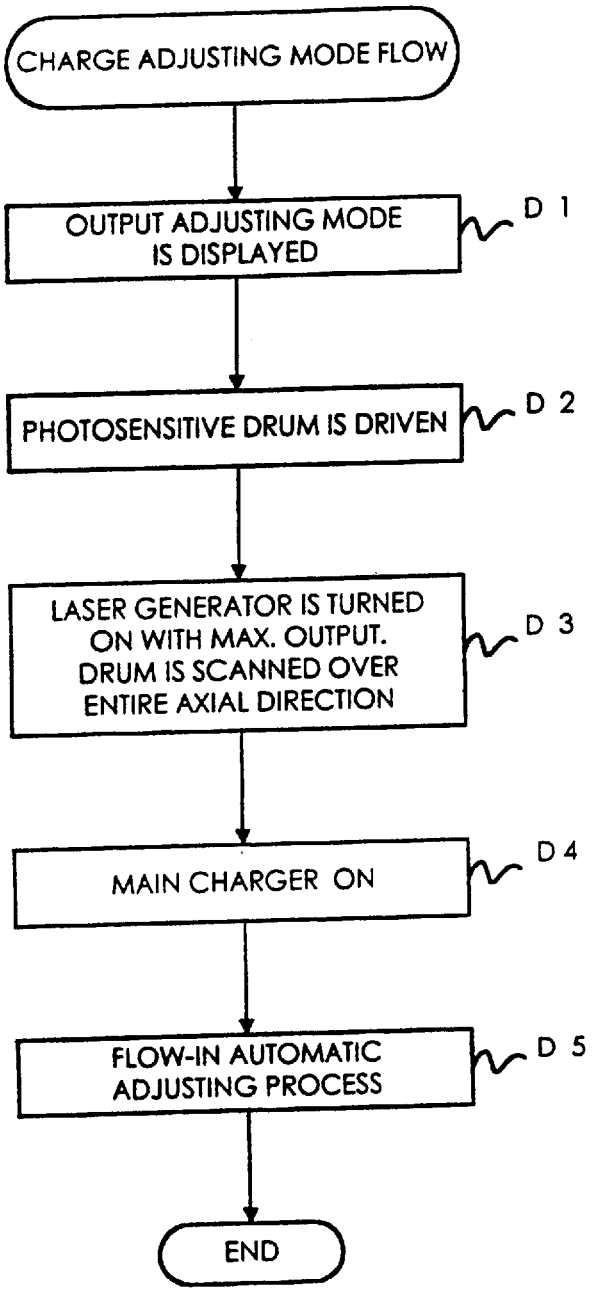
FIG. 9 is a flowchart showing the contents of the entire adjustment process of a main charger involved in the third embodiment.

Now, the output adjusting operation of the main charger 124 in the above construction will be described referring to FIG. 9.

When a pre-set main charger output adjusting code is input by the ten-key on the operation panel 137, the main controller 132 is set in the main charger output adjusting mode and this set mode is displayed on the display portion on the operation panel 137 (Step D1).

Under this state, the motor 128 is driven by the motor driver 136 (Step D2), the laser generator 110 generates laser beam at the maximum output, and the laser optical system is so controlled that this laser beam scans the photosensitive drum 117 over the entire cross direction (Step D3). Then, the main charger 124 charges the photosensitive drum 117 by prescribed current or voltage supplied from the high power transformer 135 based on the signal from the main controller 132 (Step D4).

Pursuant to this, the corona discharge process of the photosensitive drum 117 by the main charger 124, the exposing process of the entire cross direction of the photosensitive drum 117 and the auxiliary discharge process by the charge eliminator 123 are executed in order, and the automatic adjusting process of the output of the main charger 124 shown below is executed (Step D5).

The subroutine showing the automatic adjusting process in Step D5 is the same as that shown in FIG. 4 as already described and therefore, the explanation thereof will be omitted here.

In such a digital optical system using a laser optical system, the photosensitive drum is scanned by the laser beam in the entire cross direction, thus giving a role similar to the LED lamp for discharging in the embodiment described above and the automatic adjustment of the main charger is carried out.

According to the third embodiment described above, as the output adjustment of the main charger 124 is made using the photosensitive drum 117, it is possible to carry out the output adjustment enabling it to set a quantity of charge based on a photosensitive drum 117 that is used in the actual copying without requiring a tool and a work to exchange the photosensitive drum 117 with a tool.

Further, the photosensitive drum 117 charged by the main charger 124 when adjusting the output is fully discharged by scanning the photosensitive drum 117 in the entire cross direction by the laser beam at the exposing portion provided in front of the developing device 119 in the rotating direction of the photosensitive drum 117. Therefore, the developing device 119 does not apply unnecessary developer to the photosensitive drum 117. As a result, such the operations to separate the developing device 119 and others from the photosensitive drum 117 become unnecessary and accordingly, a moving mechanism of the developing device 119 and other portions and an evacuation space accompanied to their movement also become unnecessary. So, it becomes easy to make the entire construction of the digital copying machine simple and small in size. Further, the full discharging is made by the full scanning of the laser optical system and therefore, the LED array described above and a device for full discharging are not required.

Further, as the output adjustment is automatically carried out when the main controller 132 is set in the output adjusting mode, it is not required to perform such a work to adjust variable resistance of the high power transformer 135 according to the detection result. Accordingly, it becomes possible to make the adjustment work easy, a time required for the adjusting work short and achieve the uniform adjustment by eliminating fluctuation in adjustment resulting from a difference in the degree of skill of persons performing the adjustment.

In addition, as the adjusting value obtained by the adjustment are stored in the memory 138 and the next adjustment can be started using this adjusting value, the adjustment can be performed from the state with less error between a detected value and the reference value. Thus, it is possible to sharply shorten a time required for the adjustment.

Further, this invention is not limited to the embodiments described above, and needless to say, is applicable in various modifications within a range without departing from the spirit and scope thereof.

According to the present invention as described in detail, it is possible to perform the output adjustment of a charger using an actual image carrier and it is also possible to provide a charger output adjusting device of an image forming apparatus capable of making the construction and size of the entire apparatus simple and small without requiring to move the developing device and others when making the adjustment.

What is claimed is:

1. An image forming apparatus comprising:

an image carrier on which a static latent image is formed;

charging means for charging the image carrier;

means for setting an output adjustment mode;

means for developing the static latent image formed on the image carrier by applying a developer;

charge eliminating means for fully eliminating a charge on the image carrier at a position between the charging means and the developing means along the rotating direction of the image carrier when the output adjustment mode is set by the setting means;

current detecting means for detecting a current flowing into the image carrier when the charging means charges the image carrier in the output adjustment mode;

means for generating a control value corresponding to the current detected by the current detecting means; and means for supplying to the charging means a voltage corresponding to the control value.

2. An image forming apparatus as claimed in claim 1, wherein the charge eliminating means includes an LED (Light Emitting Diode) array to selectively eliminate the charge on the image carrier.

3. An image forming apparatus as claimed in claim 1, wherein the charge eliminating means includes an exposure lamp that in a normal copying mode forms a static latent image by exposing the image carrier.

4. An image forming apparatus as claimed in claim 3, further comprising:

light amount detecting means for detecting an amount of a light exposure to the image carrier by the exposure lamp; and means for stopping the output adjustment mode when the amount of the light detected by the light amount detecting means is smaller than a predetermined amount.

5. An image forming apparatus as claimed in claim 1, wherein the charge eliminating means includes a laser optical system that scans the image carrier over its entire cross direction with a laser beam.

6. A method for adjusting a charge on a rotatable image carrier included in an image forming apparatus, the method comprising the steps of:

charging the image carrier;

setting an output adjustment mode;

developing a static latent image formed on the image carrier by applying a developer;

fully eliminating a charge on the image carrier between the charging step and the developing step to remove the static latent image on the image carrier when the output adjustment mode is set;

detecting a current flowing into the image carrier when the image carrier is charged by the charging step in the output adjustment mode;

generating a control value corresponding to the current detected by the detecting step; and supplying a voltage corresponding to the control value for use in the charging step.

7. A method as claimed in claim 6, wherein the charge eliminating step uses an LED (Light Emitting Diode) array to selectively eliminate the charge on the image carrier.

8. A method as claimed in claim 6, wherein the charge eliminating step uses an exposure lamp to eliminate the charge on the image carrier, wherein the exposure lamp in a normal copying mode forms a static latent image by exposing the image carrier.

9. A method as claimed in claim 8 further comprising the steps of detecting an amount of light exposure to the image carrier by the exposure lamp, and stopping the output adjustment mode when the amount of the light detected is smaller than a predetermined amount.

10. A method as claimed in claim 6, wherein the charge eliminating step uses a laser optical system that scans the image carrier over its entire cross direction with a laser beam to eliminate the charge on the image carrier.

* * * * *